US010850320B2

(12) United States Patent
Hartmann

(10) Patent No.: US 10,850,320 B2
(45) Date of Patent: Dec. 1, 2020

(54) APPARATUS FOR LOW-PRESSURE CASTING

(71) Applicant: Kurtz GmbH, Kreuzwertheim (DE)

(72) Inventor: Lothar Hartmann, Leinach (DE)

(73) Assignee: Kurtz GmbH, Kreuzwertheim (DE)

( * ) Notice: Subject to any disclaimer, the term of this patent is extended or adjusted under 35 U.S.C. 154(b) by 100 days.

(21) Appl. No.: 16/113,049

(22) Filed: Aug. 27, 2018

(65) Prior Publication Data

US 2019/0070659 A1 Mar. 7, 2019

(30) Foreign Application Priority Data

Sep. 1, 2017 (DE) ..... 20 2017 105 293 U

(51) Int. Cl.
*B22C 9/08* (2006.01)
*B22D 18/04* (2006.01)
*B22D 17/30* (2006.01)

(52) U.S. Cl.
CPC ..... *B22C 9/088* (2013.01); *B22D 17/30* (2013.01); *B22D 18/04* (2013.01)

(58) Field of Classification Search
CPC ..... B22D 17/30; B22D 18/04; B22C 9/08; B22C 9/088
USPC ..... 164/303, 306, 119, 335, 259
See application file for complete search history.

(56) References Cited

U.S. PATENT DOCUMENTS 4,585,050 A * 4/1986 Merrien et al. ..... B22D 18/08 164/119
5,205,346 A * 4/1993 Kuhn et al. ..... B22D 18/04 164/133
6,550,526 B1 * 4/2003 Brungs et al. ..... B01F 13/0809 164/119
6,581,673 B1 6/2003 McKibben et al.

FOREIGN PATENT DOCUMENTS

| | | |
|---|---|---|
| CN | 203843149 | 9/2014 |
| DE | 486524 | 11/1929 |
| DE | 2361934 | 6/1974 |
| DE | 199 01 705 | 7/2000 |
| DE | 199 36 973 | 2/2001 |
| DE | 2004 050 781 | 4/2006 |
| DE | 2008 051 998 | 5/2009 |

(Continued)

OTHER PUBLICATIONS

Search Report dated Oct. 17, 2018 from European Application No. 18188900.7, filed on Aug. 14, 2018.

(Continued)

*Primary Examiner* — Kevin P Kerns
(74) *Attorney, Agent, or Firm* — HoustonHogle LLP

(57) ABSTRACT

An apparatus for low-pressure casting includes a furnace wall bounding a furnace chamber, a melting crucible unit located in the furnace chamber, a heating device for heating the melting crucible unit, and at least one pressurizing unit for applying overpressure to the melting crucible unit. The furnace chamber in a top view has a length which is greater than its width, so that the furnace chamber has an elongated shape in a longitudinal direction, wherein preferably several (Continued)

riser pipes extending vertically are distributed roughly evenly over around 60% to 95% of the length in the longitudinal direction of the melting crucible or crucibles.

19 Claims, 4 Drawing Sheets

(56) References Cited

FOREIGN PATENT DOCUMENTS

| | | |
|---|---|---|
| DE | 102011112560 | 11/2012 |
| GB | 1434969 | 5/1976 |
| WO | WO 2006010601 | 2/2006 |

OTHER PUBLICATIONS

Search Report created on May 30, 2018 from German Application No. 20 2017 105 293.1, filed on Sep. 1, 2017.

* cited by examiner

APPARATUS FOR LOW-PRESSURE CASTING

RELATED APPLICATIONS

This application claims priority to German application 20 2017 105 293.1, filed on Sep. 1, 2017, which is incorporated herein by reference in its entirety.

BACKGROUND OF THE INVENTION

The present invention relates to an apparatus for low-pressure casting.

Low-pressure casting is an industrial casting process for the production of castings. It involves molten metal, in particular aluminum, but also magnesium, copper, iron and/or steel being pressed by means of at least one riser pipe from below into a mold cavity of a casting mold, generally a permanent mold, or a sand mold or precision casting mold (shell mold). A suitable upwards movement of the liquid metal against the force of gravity is effected generally by gas pressurization (gas pressure principle) of the melt.

A suitable apparatus for low-pressure casting therefore includes a furnace chamber, in which a melting crucible is located, and a suitable heating device for heating a melt present in the melting crucible. The furnace chamber may also be pressurized by a gas, while a riser pipe is so arranged in the melting crucible that, after suitable pressurization of the furnace chamber by a gas, e.g. compressed air, the melt is pressed via a riser pipe into a generally two-part casting mold (movable top part, fixed bottom part), wherein a mold cavity of the casting mold is filled by the rising melt. The casting mold may have a plunger and compressed-air-controlled closures.

Such melting crucibles are made of clay graphite and are fired during production. Viewed from above, the crucibles have a circular shape. Owing to the crucible production process, the maximum size of the crucible is limited. An inside diameter of this crucible amounts to approximately 1730 millimeters (mm). A maximum inside diameter of around 1350 mm may be mounted on the riser pipe or its central longitudinal axes.

Under the pressure of gas, the melt rises through the riser pipe into a mold cavity. After complete filling of the casting mold, the gas pressure is maintained, in order to ensure subsequent feeding to compensate for volume deficits (blowholes) during the transition from liquid to solid state. At the same time, a directed solidification from top to bottom is desired, in order to achieve the most advantageous cast product shaping and/or cross-sectional gradations. This technique promotes a dense and pore-free casting.

In designing the casting mold, care must be taken that the liquid metal fills all parts of the mold, before solidification begins in areas away from the sprue and in thin-walled sections. To prevent the occurrence of volume deficits, the formation of blowholes, it is generally necessary in certain areas of the casting either to delay solidification through insulation or to accelerate it by means of cooling pins.

In order to create hollow spaces or complex contours, casting cores, also in the form of core packages, are required. These are fixed at appropriate points in the permanent mold before mold filling. After cooling, the mold is opened and the casting removed. The inserted cores, the binder of which has gassed or burned away, are removed from the casting using a vibrator device. Also used are salt cores, which are removed by placing the casting in water. Metal cores are pulled out using a crowbar, before the mold is opened.

The use of sand cores in the molds to be cast, or the casting of complete sand packages, is a widely used process. If, however, an extremely high quality, without visible defects, is required, cores of gypsum are also used.

Sand casting equipment offers a wide range of applications. This begins with the molds, which range from chemically bonded sand molds through designs with green sand mold equipment to gypsum molds for special parts with high demands for accuracy of contours. In precision casting in ceramic molds, even fine structures with 1 mm wall thickness are possible. The diversity of the molds is matched by the variety of parts. From small parts weighing only a few kilograms (kg) up to entire housings with a casting weight of 260 kg and above, there is a wide range from the high tech prototype individual part to high-volume production applications.

Geometrically complex ceramic clusters should be filled quickly but gently. This type of mold filling is necessary for the casting of very thin-walled parts with many changes in cross-section. At the same time the specified mechanical properties must also be obtained.

DE 199 36 973 A1 discloses an apparatus for the low-pressure casting of metals. This includes a casting furnace with a filling chamber and a riser pipe, which may be connected successively at the end via a casting nozzle with sand casting mold boxes with hollow spaces. The casting nozzle is made of refractory material and has an interchangeable mouthpiece.

Disclosed in DE 10 2008 051 998 A1 is a casting method in which casting material from a low-pressure furnace is conveyed under low pressure via a sprue column against the force of gravity to a plastic model of a casting body embedded in sand in a casting vessel. This involves destruction of the plastic model, leaving behind a hollow space which is filled up with the casting material. In this connection it is provided that the low pressure in the low-pressure furnace, on completion of casting, is reduced to the extent that at least a portion of the casting material, still in the sprue column and still liquid, flows back into the low-pressure furnace.

Disclosed in DE 10 2004 050 781 A1 is a low-pressure full mold casting method in which it is intended that controlled mold filling shall be facilitated wherein, in the area of a connecting hole of a mold container, the liquid metal is conveyed through a connection piece with low thermal conductivity. As a consequence, controlled solidification from bottom to top and a fine-grained structure of the original piece should be obtained.

SUMMARY OF THE INVENTION

The problem of the present invention is to provide an apparatus for casting which may be used to produce, safely and reliably, components with large base areas and/or relatively thin-walled components.

A further problem of the present invention is to provide an apparatus for casting which is energy-efficient, of simple design, and safe and reliable in operation.

One or more of these problems is or are solved by the features of the independent patent claim 1. Advantageous developments thereof are set out in the dependent claims.

According to the invention, an apparatus for low-pressure casting is provided. This includes a furnace wall bounding a furnace chamber, a melting crucible unit located in the furnace chamber, a heating device for heating the melting crucible, and at least one pressurizing unit for applying overpressure to the melting crucible. The present invention is characterized in that the furnace chamber in a top view has a length which is greater than its width, so that the furnace chamber has an elongated shape in a longitudinal direction, wherein preferably several riser pipes extending vertically are distributed roughly evenly over around 60% to 95% of the length in the longitudinal direction of the melting crucible or crucibles.

In the context of the present invention, a mold elongated in a longitudinal direction is understood to mean that the furnace chamber viewed from above is roughly rectangular, with or without rounded or chamfered corners, or else elliptical or oval. This means that molds are provided which are longer than they are wide, so that an extension along the length of the mold in a top view is described as the longitudinal direction.

Due to the fact that the furnace chamber viewed from above has a length which is greater than its width, so that the furnace chamber has an elongated shape in a longitudinal direction, wherein preferably several vertically extending riser pipes are arranged, distributed roughly evenly over around 60% to 95% of the length of the melting crucible, a much greater riser pipe spacing may be provided than for a furnace chamber with a single cylindrical melting crucible. In this way it is possible to produce relatively large and/or thin-walled castings.

Relative large casting molds for thin-walled components may frequently be filled only relatively slowly. This is disadvantageous since it leads to a relatively rapid cooling of the melt during filling. Also, due to volume deficits and the formation of blowholes, it is generally difficult to fill such molds.

With the present invention it is possible to provide a grid of riser pipes which may extend over a greater distance than in the case of conventional melting furnaces.

Below, the distance between two riser pipes at the maximum distance from one another in such a grid is described as the riser pipe distance. The distance between two adjacent riser pipes in such a riser pipe grid is described as the riser pipe spacing.

The invention thus allows grids with a minimum riser pipe spacing of 250 mm and in particular 200 mm. The riser pipe distance may be at least 105 centimeters (cm) or at least 110 cm, preferably at least 135 cm, in particular at least 150 cm or at least 180 cm or at least 200 cm. In addition, compared with conventional furnaces, the invention makes possible the provision of a greater melting crucible volume. In this way, more material is available for casting.

Especially advantageous with the present invention is that, due to the large riser pipe distance of the riser pipes arranged at their ends in the longitudinal direction, with a large mold the liquid metal reaches all mold areas over a short path within the casting mold, thereby filling them reliably, before the onset of solidification in areas of the casting mold to be cast which are further from the sprue and in particular areas which are thin-walled.

In this way the occurrence of volume deficits and the formation of blowholes are effectively prevented. Since, in the melting crucible or crucibles, several riser pipes for filling the casting mold are arranged over a greater length in the longitudinal direction, almost no area of the casting requires the delay of solidification by means of insulation or else acceleration by means of cooling pins. Consequently a suitable apparatus may be assembled extremely cost-effectively and with a low maintenance requirement, since the components otherwise needed may be omitted. Furthermore, large castings of high quality may be produced safely and reliably.

By this means it is possible to produce relatively large, thin-walled components, e.g. battery housings for motor vehicles, and to fill casting molds for the production of such components easily and efficiently.

The apparatus according to the invention for low-pressure casting thus facilitates a controlled pressure filling process and is, due to the large riser pipe distance, especially suitable for the production of thin-walled castings. The apparatus according to the invention may also be easily fully automated, making possible the achievement of good economic efficiency in series production through controllable processes.

In addition, the apparatus according to the invention allows low-turbulence mold filling with a multiplicity of different pressure curves for a mold filling process. Pressure may be controlled by a pressure curve with which up to 20 points (pressure/time) may be controlled consecutively. Through a high rate of pressure feed it is possible to obtain the best possible structural properties in the component to be cast.

It may also be provided according to the invention that the several riser pipes are arranged over a length of around 60% to 75% up to around 75% to 95% in the longitudinal direction of the melting crucible.

A minimum distance of two riser pipes each arranged endwise in the longitudinal direction, or of riser pipes arranged furthest apart or endwise in the longitudinal direction may be at least 105 cm or 110 cm up to 220 cm. Alternatively a minimum distance of the endwise arranged riser pipes may also lie in the range between 115 cm and 195 cm or 120 cm and 190 cm or 130 cm and 180 cm.

According to a first embodiment, the melting crucible means may be a trough-like melting crucible with a roughly elongated shape in a top view.

In the context of the present invention, a trough-like melting crucible is understood to mean a shape which in a top view, has a length which is greater than its width, and for example is rectangular with rounded or chamfered corners or is oval or elliptical in shape. Here the melting crucible has a greater extent in the longitudinal direction than in a width direction running transversely to the former or a width and a height extending in the vertical direction.

The heating device may then preferably be located in the melting crucible in the area of a base bounding the melting crucible and/or surrounding it in the vertical direction and/or surrounding a jacket wall of the melting crucible.

Here it may be provided that the heating device extends horizontally in the area of the base, in particular transversely to the longitudinal direction or also in the longitudinal direction.

Because the heating device is located in the area of a base bounding the melting crucible, the melt can be heated from below. The melting crucible is charged with molten melt. The heating device need therefore only provide the heat which is dissipated by the melt during holding time in the melting crucible.

Because the heating device is located in the area of the base of the melting crucible it is possible to provide, in addition, radiant heaters above the melt. This allows an additional supply of heat. Such radiant heaters, however limit the grid of riser pipes, for which reason preferably a heating device in the base area alone is provided.

The heating device preferably has several electrically operated heating rods, each of which may be fitted in or surrounded by an aluminum-titanate tube. The aluminum-titanate tubes may be arranged a short distance from the base of the melting crucible or integrated directly in the base of the melting crucible. The integration of the aluminum-titanate tube or of the heating rods in the base is advantageous for cleaning of the melting crucible.

According to a second embodiment, the melting crucible unit may have two melting crucibles, circular in a top view, and located in the furnace chamber.

Due to the fact that two melting crucibles are provided in the furnace chamber, with each melting crucible having at least one riser pipe, a large riser pipe distance may also be provided, as compared with a single melting crucible, circular in a top view.

These two melting crucibles may be spaced slightly apart from one another in the horizontal direction. Alternatively it may also be provided that the two melting crucibles slightly overlap one another in an area adjacent to one another, so that the two melting crucibles are separated from one another spatially by a common partition wall.

Each of these melting crucibles may have a separate pressurizing device. Through the provision of two melting crucibles there is a risk of differing pressures prevailing in the two melting crucibles, so that the melt is driven through the riser pipes into a mold at different pressures. Consequently, each of the two pressurizing units has a separate pressure control device for the individual crucible.

Through the provision of two separate pressurizing units, two small casting molds may be filled independently of one another but simultaneously with melt from one of the crucibles in each case. With this apparatus it is also of course possible for a large casting mold to be filled simultaneously with melt from both crucibles.

The heating device may encompass each of the melting crucibles in a horizontal top view from above at an angle of around respectively 200°, or 235°, or 270°, or 300°. In this way an extremely efficient heating of the melt held in the melting crucibles is possible.

The melting crucibles may be roughly cylindrical in shape, with a circular cross-section in a top view seen from above. The circular cross-section of the melting crucibles leads to more uniform pressure conditions in the melts, when these are subject to pressure from the pressurizing unit through the application of overpressure to the furnace chamber.

In addition, a circulation device may be provided to circulate the melts held in the melting crucible or crucibles. This circulation device may be for example in the form of a rotor or an impeller, to circulate the melts for even heating using the circulation device.

The riser pipes of the melting crucibles form preferably, viewed from above, a roughly rectangular or oval riser pipe array for filling a casting mold. The riser pipe array may include in the longitudinal direction at least eight, in particular at least ten and preferably at least twelve riser pipes and, in a width direction running transversely to the former, at least three or at least four riser pipes.

The apparatus for low-pressure casting may have a casting mold with a base area of around 2.20 meters (m)×1.35 cm.

The furnace wall may have a furnace outer wall which is preferably made of steel, a furnace partition wall provided between the furnace outer wall and the heating device and/or the melting crucible or crucibles, and preferably made of ceramic material, and a refractory coating. The furnace partition wall is made of a refractory material, a refractory lining, a refractory gunning material, or of refractory concrete. The refractory coating is an aluminum oxide coating or is made of a refractory lining, ceramic material, a refractory ramming mix, refractory gunning material or refractory concrete.

The melting crucibles may be made substantially of clay graphite with silicon content.

By means of the apparatus according to the invention for low-pressure casting with preferably a roughly rectangular or oval riser pipe array, for example light-metal castings with especially high specifications for strength, elongation, pressure tightness and weldability may be produced.

The qualitative and economic advantages of the apparatus according to the invention for high-specification aluminum castings stem from the two melting crucibles and the riser pipe array. The melt is fed into the casting mold of steel or cast iron by gas pressurization of the melting crucibles via the riser pipe array or a distributor box, in a manner which may be programmed and controlled. Once boundary shell solidification has started, the gas pressure is increased for dense feeding. Here, the feed pressure is around four times greater than for gravity casting.

Due to the design of the apparatus according to the invention and in particular the riser pipe array, the following benefits are obtained, such as e.g.

- extremely low-turbulence mold filling with up to twenty different pressure curves for just one mold filling process,
- high rate of pressure feed for ideal structure properties, and
- high degree of automation of the casting process.

This leads to the following effects, which are reflected in casting and in cast product properties and are much better able to conform to the demands of casting users and casting designers for very robust and more lightweight castings than casting produced with known low-pressure furnaces:

- fine-grained structure through directed solidification (air/water/air-water mixtures),
- better strength and elongation properties than gravity castings,
- good pressure tightness due to structure with minimal oxide and pore content,
- trouble-free weldability through freedom from pores, and
- great economic efficiency in series production from controllable processes.

The low-pressure casting of aluminum castings in permanent molds on the apparatus according to the invention has considerable advantages due to the trough-like melting crucible and the two melting crucibles and riser pipe array respectively. For example, mold filling is extremely low-turbulence and may be controlled at the machine via different pressure curves for only one mold filling process, which is especially useful for the production of quality high-grade parts. During mold filling, the melt has no contact with the environment, and so remains clean. Through the high rate of pressure feed, these castings are dense and have the best structural properties.

The casting process on an apparatus for low-pressure casting according to the invention is highly suitable for automation, making the process also especially suited to series production. The apparatus for low-pressure casting may therefore be provided with a casting control unit which, alongside advance pressure determination, also facilitates the use of several further pressure steps with a control accuracy of +/−1 millibar (mbar), and may be equipped with handling robots, peripheral equipment and conveyor systems. A highly productive variant is an apparatus for low-pressure casting with shuttle changeover furnace and media space cooling (water, air, mist), plus control over time and temperature, thereby facilitating the process-safe production even of complex casting ranges such as engine block or chassis parts.

Because of the controlled pressure filling process, low-pressure casting is especially suitable for the production of thin-walled castings.

The present invention may also be in the form of an apparatus for low-pressure permanent mold casting. This is especially useful for the production of light-metal castings (aluminum and magnesium). The low-pressure castings are used in demanding applications involving machine-building, chassis, gearbox and engine construction, and for vacuum-tight or hydraulic-tight cast products.

The proportion of low-pressure casting parts within the aluminum castings produced in permanent molds is growing constantly, partly in substitution for spheroidal graphite iron (GJS) or aluminum pressure castings, since the process is an alternative wherever quality and economic efficiency are required. Sand cores may be used in low-pressure casting and the parts may be heat-treated using suitable methods. The present invention thus offers a very wide range of application.

For the production of high-strength iron castings, the present invention may also be designed for low-pressure sand casting, where sand molds are used instead of metal permanent molds.

The above and other features of the invention including various novel details of construction and combinations of parts, and other advantages, will now be more particularly described with reference to the accompanying drawings and pointed out in the claims. It will be understood that the particular method and device embodying the invention are shown by way of illustration and not as a limitation of the invention. The principles and features of this invention may be employed in various and numerous embodiments without departing from the scope of the invention.

BRIEF DESCRIPTION OF THE DRAWINGS

In the accompanying drawings, reference characters refer to the same parts throughout the different views. The drawings are not necessarily to scale; emphasis has instead been placed upon illustrating the principles of the invention. Of the drawings.

DETAILED DESCRIPTION OF THE PREFERRED EMBODIMENTS

The invention now will be described more fully hereinafter with reference to the accompanying drawings, in which illustrative embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

As used herein, the term "and/or" includes any and all combinations of one or more of the associated listed items. Further, the singular forms and the articles "a", "an" and "the" are intended to include the plural forms as well, unless expressly stated otherwise. It will be further understood that the terms: includes, comprises, including and/or comprising, when used in this specification, specify the presence of stated features, integers, steps, operations, elements, and/or components, but do not preclude the presence or addition of one or more other features, integers, steps, operations, elements, components, and/or groups thereof. Further, it will be understood that when an element, including component or subsystem, is referred to and/or shown as being connected or coupled to another element, it can be directly connected or coupled to the other element or intervening elements may be present.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 1:
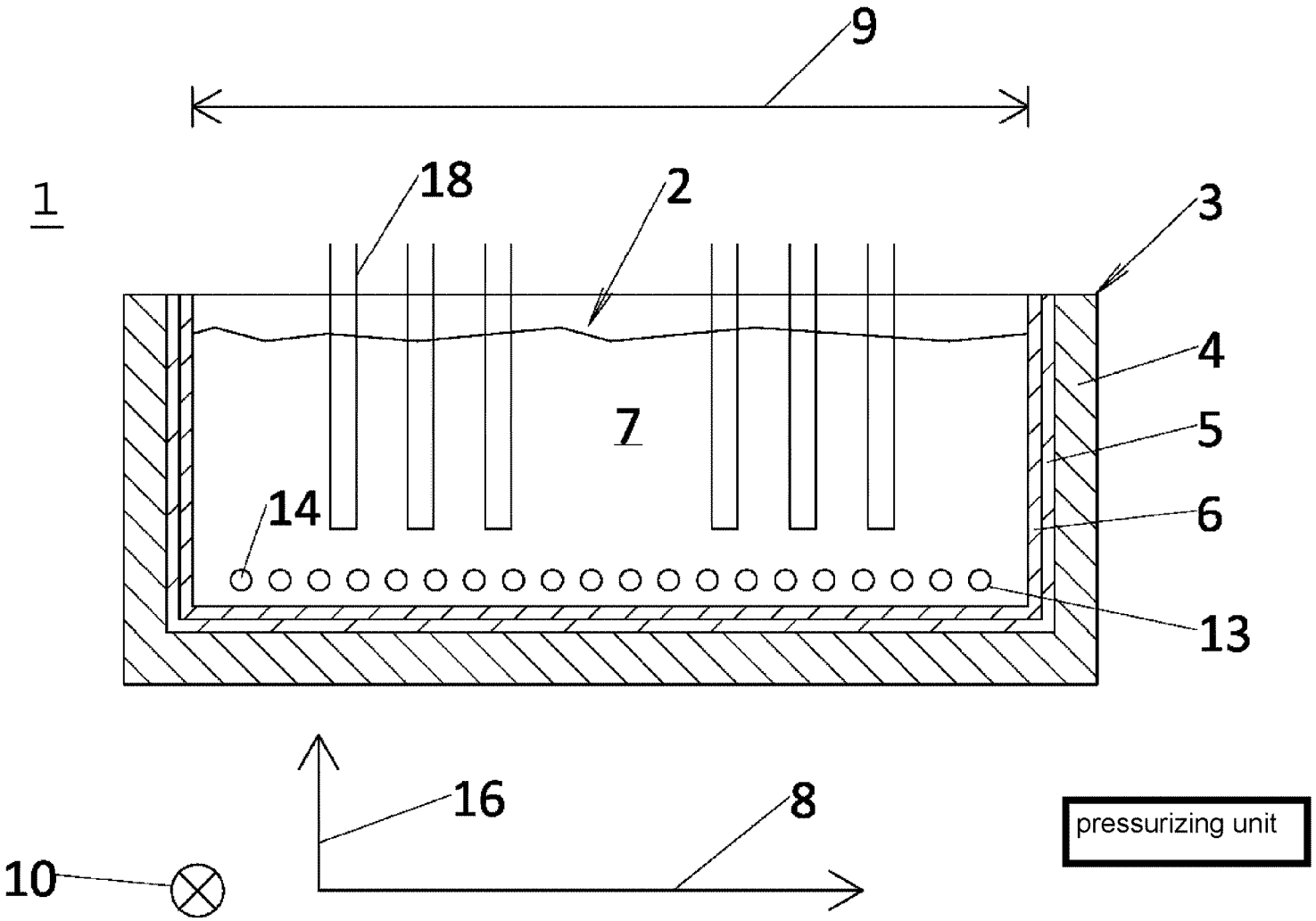
FIG. 1 is a side cutaway view of an apparatus according to a first embodiment of the invention for low-pressure casting, without a furnace cover.
Figure 2:
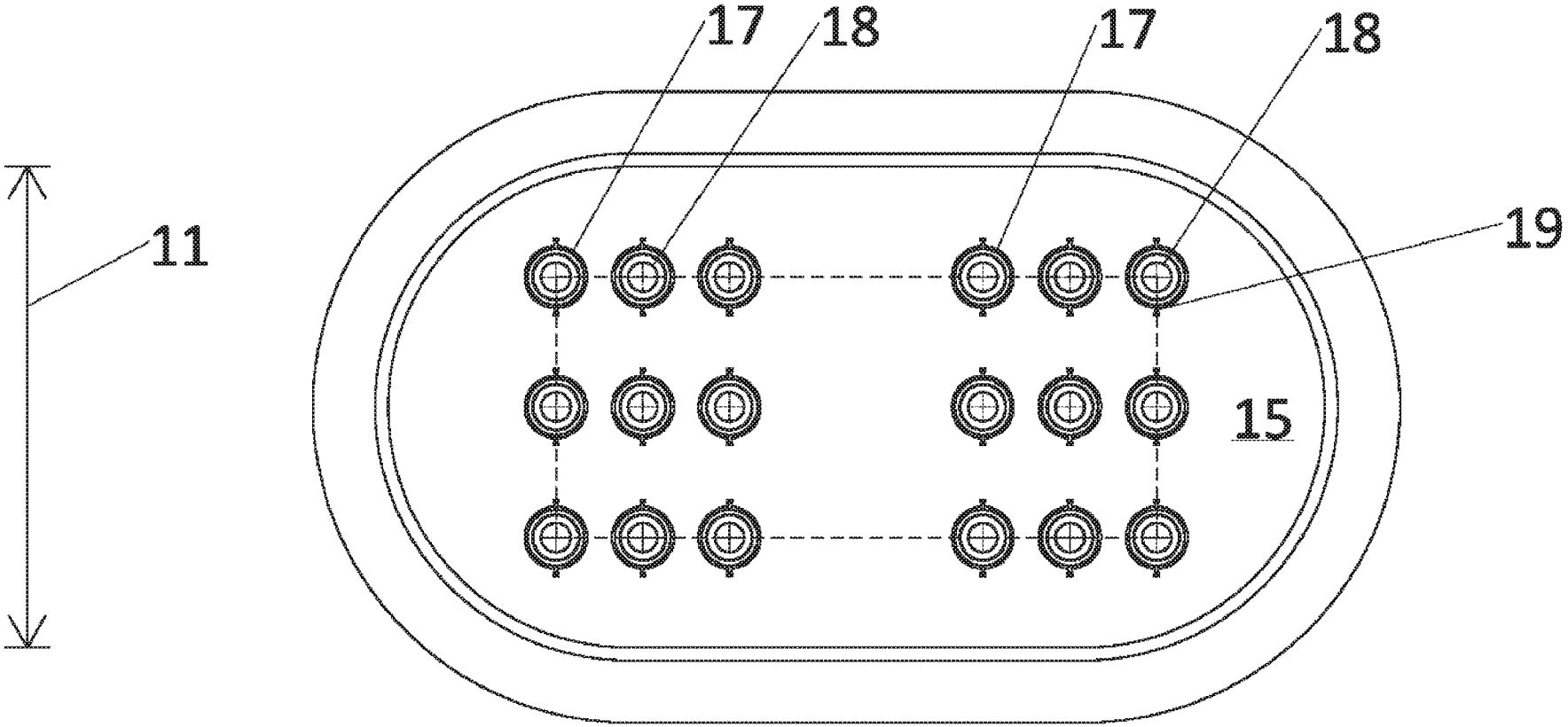
FIG. 2 is a top view of the apparatus according to the first embodiment, with a furnace cover.

An apparatus 1 for low-pressure casting according to the invention is described by way of example below with the aid of a first embodiment (FIGS. 1 and 2).

The apparatus 1 includes a furnace chamber 2. The furnace chamber 2 is bounded by a furnace wall 3.

The furnace wall 3 has a furnace outer wall 4 which is made of steel. The furnace wall 3 also has a furnace partition wall 5 which is made of a refractory material, e.g. a refractory lining, ceramics, refractory ramming mix, refractory gunning material or refractory concrete.

The furnace partition wall 5 is coated with a refractory coating 6, in particular an aluminum oxide coating, a refractory lining, ceramics, refractory ramming mix, refractory gunning material or refractory concrete. The aluminum oxide coating may be applied with a binder to the furnace partition wall or applied in the form of panels.

The ceramic material is preferably a dense, not easily wetted refractory oxide ceramic material with low thermal expansion.

In use, the refractory coating is in contact with the melt, thus forming a melting crucible unit 6. According to the first embodiment, this melting crucible unit 6 is trough-like in shape, and the furnace wall 3 thus forms a trough-like melting crucible 7.

The melting crucible 7 has an elongated shape extending, in the horizontal plane, in a longitudinal direction 8.

The length 9 of the trough-like melting crucible 7 in the longitudinal direction 8 comes to around 190 cm to 250 cm.

Provided transversely to this longitudinal direction 8 in the horizontal plane is a width direction 10, over which the trough-like melting crucible extends over a width 11 of around 120 cm to 150 cm.

Due to a corresponding extension in the vertical direction 16 or in height, the melting crucible 7 is able to hold a content of 4000 kg to 5000 kg of melt, in particular aluminum melt.

Provided in the area of a base 12 of the melting crucible is a heating device 13.

The heating device 13 comprises preferably several electrical heating rods 14, extending horizontally in the area of the base 12.

The apparatus 1 also has a furnace top 15 covering the furnace chamber and in particular the melting crucible 7.

According to this embodiment, eighteen riser pipe sleeves 17 are provided in the furnace top 15. Corresponding riser pipes 18 are arranged in the riser pipe sleeves 17. The eighteen riser pipes 18 form a rectangular riser pipe array 19 (broken line).

A casting mold (not shown), for example in two parts, may be arranged on the riser pipe array 19.

This casting mold may for example have a movable top part and an immovable or stationary bottom part. The casting mold bounds a mold cavity which may be filled by the melt rising through the riser pipes. A casting mold of this kind also has at least one plunger.

With the furnace top 15 fitted on to the furnace wall 3, the furnace chamber 2 becomes an airtight container or space.

The furnace chamber 2 also has at least one port for connection to a pressurizing unit (not shown) for the application of overpressure to the furnace chamber. The apparatus is preferably in the form of a furnace for low-pressure casting. The overpressure is generated by the feeding of dried air (dew point ca. −40° C.).

Filling holes (not shown) which can be closed by flaps may be provided in the furnace top 15.

These holes are so dimensioned that a circulation device (not shown), such as e.g. a rotor or an impeller, may be guided through them.

For cleaning the furnace it is then provided that the circulation device is dipped into the melt and gas is supplied. The gas used is preferably nitrogen or argon. The gas bubbles convey the dirt to the surface, where it can be removed as skimmings.

This process may also be effected by lifting the furnace top 15. The greater the open surface of the holes which may be closed by flaps, or the surface of the melting crucible in a top view, the easier is the cleaning process.

The holes may also be provided for filling the melting crucible.

For cleaning the furnace or the melt contained therein, the furnace may be provided with several sinks, via which purge gas may be fed into the furnace.

One or more filling channels may also be provided. Such filling channels allow filling of the furnace without the need to traverse the furnace out of an associated machine. Filling is effected preferably via a filter device, so as to limit the ingress of dirt.

Figure 3:
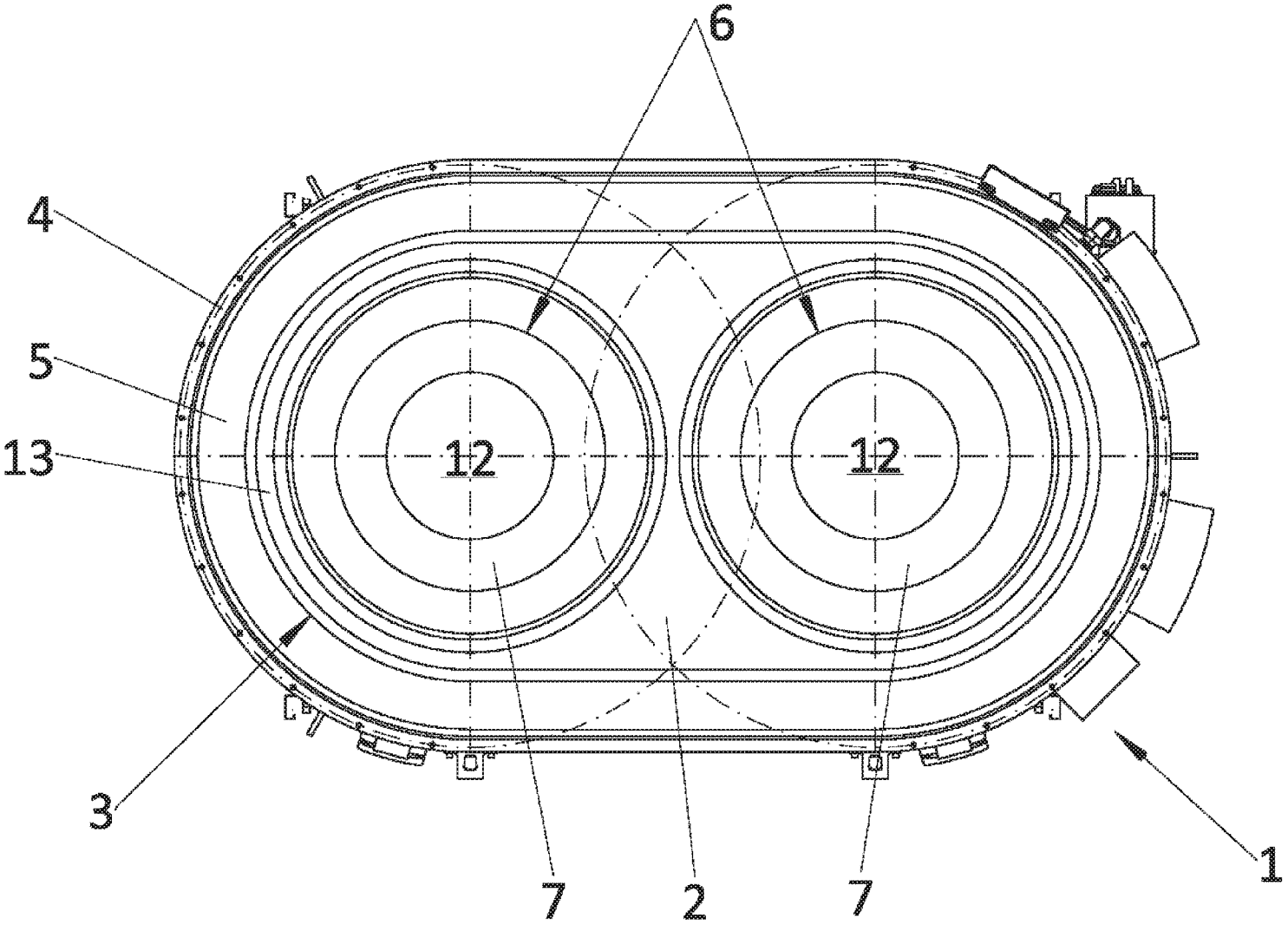
FIG. 3 is a top view of the apparatus according a second embodiment, without a furnace cover.
Figure 4:
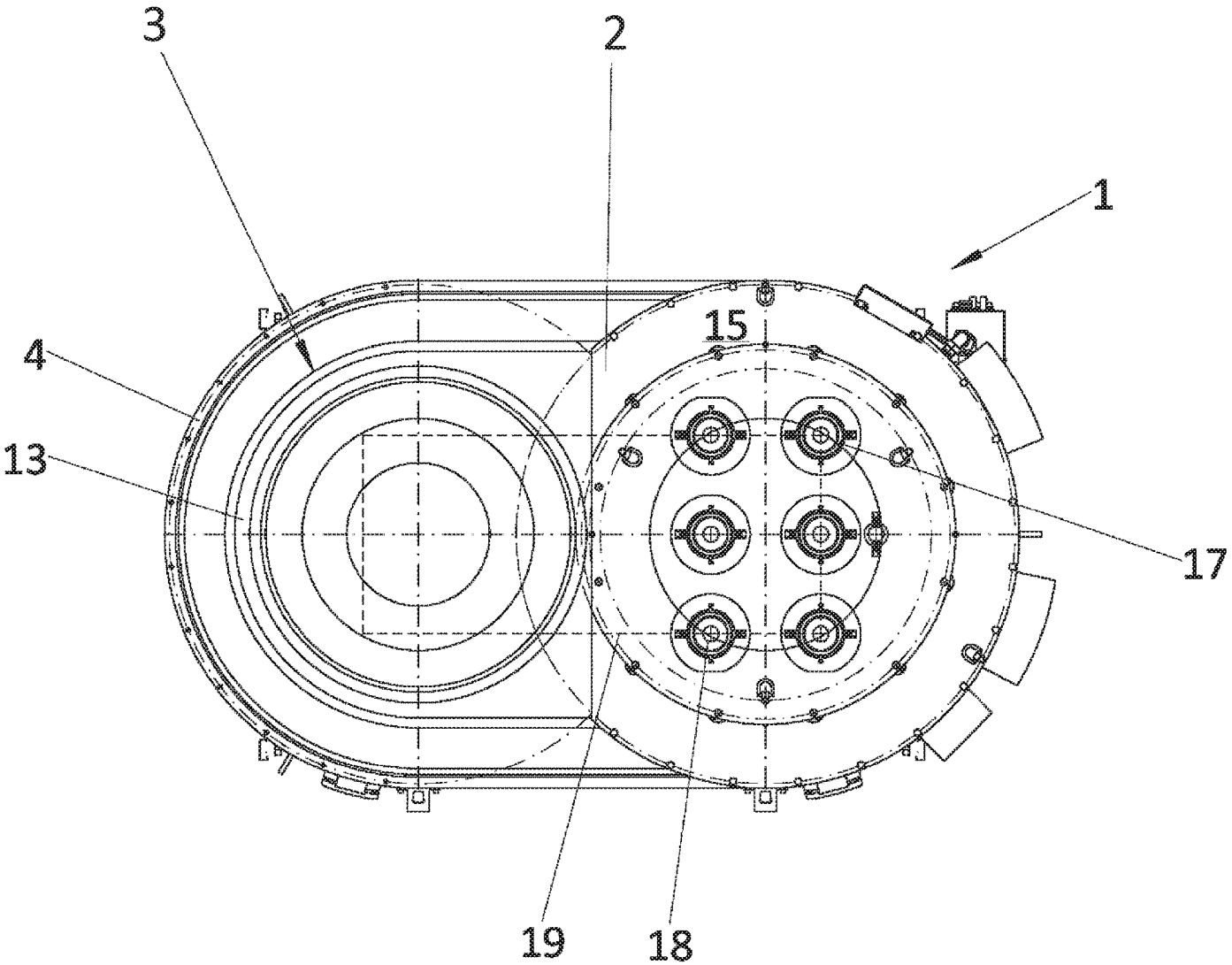
FIG. 4 is a top view of the apparatus according to the second embodiment in which the apparatus includes a melting crucible covered by a cover which has six riser pipes.

The apparatus 1 according to the invention for low-pressure casting will be explained below with the aid of a second embodiment (FIGS. 3 and 4). Unless otherwise described, this apparatus has the same technical features as an apparatus according to the first embodiment. Identical components are provided with the same reference numbers.

The apparatus 1 includes the furnace chamber 2. The furnace chamber 2 is bounded by the furnace wall 3.

The furnace wall 3 has the furnace outer wall 4, which is made of steel. The furnace wall 3 also has the furnace partition wall 5, which is made of ceramic material.

The furnace chamber 2 is roughly oval in shape, viewed from above or in a horizontal cross-section.

The melting crucible unit 6 is located in the furnace chamber 2.

The melting crucible unit 6 comprises at least two melting crucibles 7, which are located in the furnace chamber 2. The melting crucibles 7 are substantially made of graphite with a silicon content.

The melting crucibles 7 are cylindrical with a circular cross-section with a diameter of around 1.3 m.

The heating device 13 is located in the area between the furnace partition wall 5 and the two melting crucibles 7.

The heating device 13 surrounds jacket walls of the two melting crucibles in a horizontal top view from above at an angle of around 270°.

The apparatus 1 also has one or two furnace tops 15 covering the furnace chamber and in particular the melting crucibles 6.

Provided according to this embodiment, on the furnace top or tops 15 are riser pipe sleeves 17 spaced equally apart from one another. The furnace top 15 is of similar design in the area of both melting crucibles 6, so that according to this embodiment, twelve riser pipe sleeves 17 are provided.

The riser pipes 18 are mounted in the riser pipe sleeves 17. In each case six riser pipes 18 of a melting crucible 6 are arranged at right-angles and spaced equally apart.

The twelve riser pipes 18 from the riser pipe array 19 (broken line).

The riser pipe array 19 is therefore similarly rectangular in the present embodiment. A casting mold (not shown), for example in two parts, may be mounted on this riser pipe array 19.

The casting mold may for example have a movable top part and an immovable or stationary bottom part. The casting mold bounds a mold cavity which may be filled by the melt rising through the riser pipes. A casting mold of this kind also has at least one plunger.

Depending on the casting mold, the riser pipe array may have almost any desired number of riser pipes. In each melting crucible, one, two, three, four, five, six, seven, eight, nine, ten, eleven, twelve or more riser pipes may be fitted. Preferably, however, the riser pipes are always spaced equally apart from one another and generally form, in accordance with the oval furnace chamber or on account of the two melting crucibles 6, a riser pipe array 16 extending in a plane perpendicular to the crucible longitudinal direction.

The riser pipes may also be in the form of multiple riser pipes.

LIST OF REFERENCE NUMBERS

1 apparatus
2 furnace chamber
3 furnace wall
4 furnace outer wall
5 furnace partition wall
6 melting crucible unit
7 melting crucible
8 longitudinal direction
9 length
10 width direction
11 width
12 base
13 heating device
14 heating rods
15 furnace top
16 vertical direction
17 riser pipe sleeve
18 riser pipe
19 riser pipe array While this invention has been particularly shown and described with references to preferred embodiments thereof, it will be understood by those skilled in the art that various changes in form and details may be made therein without departing from the scope of the invention encompassed by the appended claims.

What is claimed is:

1. Apparatus for low-pressure casting including a furnace wall bounding a furnace chamber, a melting crucible unit located in the furnace chamber, a heating device for heating the melting crucible unit, at least one pressurizing unit for applying overpressure to the melting crucible unit, wherein the furnace chamber in a top view has a length which is greater than its width, so that the furnace chamber has an elongated shape in a longitudinal direction, wherein riser pipes extending vertically are distributed roughly evenly over at least 60% of a length in the longitudinal direction of the melting crucible unit; and wherein the riser pipes form a riser pipe array that includes in the longitudinal direction between four and twelve riser pipes and, in a width direction running transversely to the longitudinal direction, two or more riser pipes.

2. The apparatus according to claim 1, wherein the riser pipes are distributed roughly evenly over 95% of the length in the longitudinal direction of the melting crucible unit.

3. The apparatus according to claim 1, wherein a minimum distance of two riser pipes each arranged endwise in a longitudinal direction is at least 105 centimeters.

4. The apparatus according to claim 1, wherein a minimum distance of two riser pipes each arranged endwise in a longitudinal direction is at least 110 centimeters.

5. The apparatus according to claim 1, wherein a minimum distance of two riser pipes each arranged endwise in a longitudinal direction is at least 135 centimeters.

6. The apparatus according to claim 1, wherein a minimum distance of two riser pipes each arranged endwise in a longitudinal direction is at least 180 centimeters.

7. The apparatus according to claim 1, wherein the melting crucible unit is a trough-like melting crucible with a roughly elongated shape in a top view.

8. The apparatus according to claim 1, wherein the melting crucible unit has at least two melting crucibles, roughly circular in a top view.

9. The apparatus according to claim 8, wherein the at least two melting crucibles are separated from one another spatially by a common partition wall.

10. The apparatus according to claim 8, wherein each melting crucible has a pressurizing unit.

11. The apparatus according to claim 1, wherein the heating device surrounds a jacket wall of the melting crucible unit and/or the heating device is arranged in the vertical direction in the area of a base bounding the melting crucible unit.

12. The apparatus according to claim 1, wherein the riser pipe array is rectangular and/or oval shaped.

13. The apparatus according to claim 1, wherein the riser pipe array comprises in the longitudinal direction between six and eight riser pipes and, in the width direction, three to four riser pipes.

14. The apparatus according to claim 1, wherein the furnace wall has a furnace outer wall, a furnace partition wall and a refractory coating.

15. The apparatus according to claim 14, wherein the furnace outer wall is made of steel and/or the furnace partition wall is made of a refractory material, a refractory lining, a refractory gunning material or refractory concrete.

16. The apparatus according to claim 15, wherein the refractory coating is an aluminum oxide coating or is made of a refractory lining, ceramic material, a refractory ramming mix, a refractory gunning material or refractory concrete.

17. The apparatus according to claim 1, wherein the heating device is located in the vicinity of a base or is integrated in the base.

18. The apparatus according to claim 1, wherein the heating device comprises several electrically operated heating rods.

19. The apparatus according to claim 18, wherein each of the heating rods is surrounded by an aluminium-titanate tube.

* * * * *